US006530634B1

(12) United States Patent
Hara

(10) Patent No.: US 6,530,634 B1
(45) Date of Patent: Mar. 11, 2003

(54) INK JET RECORDING APPARATUS

(75) Inventor: Kazuhiko Hara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/397,451

(22) Filed: Sep. 16, 1999

(30) Foreign Application Priority Data

Sep. 16, 1998 (JP) ..... 10-262120
May 25, 1999 (JP) ..... 11-145017

(51) Int. Cl.[7] ..... B41J 2/175
(52) U.S. Cl. ..... 347/7; 347/37; 347/108
(58) Field of Search ..... 347/7, 19, 37, 347/23, 85–87, 108

(56) References Cited

U.S. PATENT DOCUMENTS

| | | | | | |
|---|---|---|---|---|---|
| 5,068,806 | A | * | 11/1991 | Gatten | 358/1.14 |
| 5,179,389 | A | * | 1/1993 | Arai et al. | 347/14 |
| 5,623,290 | A | * | 4/1997 | Iida et al. | 347/7 |
| 5,631,674 | A | * | 5/1997 | Shinada et al. | 347/7 |
| 5,676,475 | A | * | 10/1997 | Dull | 400/174 |
| 5,742,302 | A | * | 4/1998 | Kohri et al. | 347/23 |
| 5,907,334 | A | * | 5/1999 | Hirano et al. | 347/23 |
| 5,949,477 | A | * | 9/1999 | Arai et al. | 347/23 |
| 6,065,831 | A | | 5/2000 | Kawaura et al. | |
| 6,247,784 | B1 | * | 6/2001 | Obana et al. | 347/37 |

FOREIGN PATENT DOCUMENTS

| | | | | |
|---|---|---|---|---|
| EP | 0844094 A2 | * | 5/1998 | 347/7 |
| JP | 57-60233 U | | 4/1982 | |
| JP | 63-27264 A | | 2/1988 | |
| JP | 2-21828 U | | 2/1990 | |
| JP | 3234369 | | 9/1991 | |
| JP | 4-133775 A | | 5/1992 | |
| JP | 4195944 | | 6/1992 | |
| JP | 5-69553 A | | 3/1993 | |
| JP | 2716891 | | 3/1993 | |
| JP | 03234369 | | 3/1993 | |
| JP | 5-147322 A | | 6/1993 | |
| JP | 04195944 | | 1/1994 | |
| JP | 7-65664 A | | 3/1995 | |
| JP | 05207697 | | 3/1995 | |
| JP | 08-323991 A | | 12/1996 | |
| JP | 9-20017 A | | 1/1997 | |
| JP | 9-70962 A | | 3/1997 | |
| JP | 10-44396 A | | 2/1998 | |
| JP | 08209543 | | 2/1998 | |
| JP | 10058791 | | 3/1998 | |
| JP | 10-129000 A | | 5/1998 | |
| JP | 10-202913 A | | 8/1998 | |

* cited by examiner

*Primary Examiner*—Craig Hallacher
(74) *Attorney, Agent, or Firm*—Stroock & Stroock & Lavan LLP

(57) ABSTRACT

The ink jet recording apparatus comprises an ink end detector for detecting when ink in each of the cartridges mounted on the carriage is exhausted, and a cover detector for detecting whether the cover member attached to the casing body of the apparatus is open. And when the ink end detector detects that the ink has been exhausted and the cover detector detects that the cover member is open, a carriage driver is driven and moves the carriage and positioned it at an opening formed in the casing body for the exchange of ink cartridges. Therefore, the operability for the exchange of ink cartridges when the ink has been exhausted can be improved.

43 Claims, 5 Drawing Sheets

INK JET RECORDING APPARATUS

BACKGROUND OF THE INVENTION

The present invention relates to an ink jet recording apparatus comprising: a recording unit including an ink jet recording head and an ink cartridge that are mounted on a carriage which moves in the width of a recording sheet; and a casing body, wherein the main body for accommodating the recording unit and having an opening for exchanging ink cartridges which is provided on a part of the moving path of the carriage. In particular, the present invention pertains to a control technique for moving the carriage to the exchange opening formed in the casing body.

Since owing to the development of personal computers graphic processing can be performed comparatively easily, a demand exists for recording apparatuses that can, for example, output high quality hard copies of color images displayed on screens. In response to this demand, recording apparatuses in which ink jet recording heads are mounted are being produced. Since during printing the noise made by such ink jet recording apparatuses is comparatively low, and since the apparatuses can deposit small dots at a high density, the apparatuses are presently being used to perform a variety of different types of printing, to include color printing.

Such an ink jet recording apparatus comprises: ink jet recording heads, for receiving ink from ink cartridges; and a paper feeding mechanism, for moving a recording sheet relative to the recording head. During the printing process, the recording heads, which are carried along by a carriage while it moves the width of a recording sheet, eject ink droplets that are deposited on the recording sheet. Mounted on the common carriage are a black recording head for ejecting black ink, and color recording heads for ejecting yellow, cyan and magenta inks, for example, so that not only can text be printed in black ink, but also full color printing can be performed by changing the ratio of the inks to be ejected.

Since the ink jet recording heads perform printing by pressurizing ink in a pressure generating chamber and then ejecting that ink through nozzles as ink droplets, a print failure can be caused by an increase in the viscosity of the ink or the solidification of the ink due to the evaporation of a solvent through nozzle orifices, by the attachment of dust particles, or by the entry of air bubbles.

Therefore, the ink jet recording apparatus further comprises a capping member for sealing the nozzle orifices of the recording head while printing is not being performed, and a cleaning device for cleaning a nozzle plate as needed. The capping member not only serves as a lid for protecting ink at the nozzle orifices from being dried out when printing is not being performed, but when the nozzle orifices are clogged, it also seals a nozzle plate and induces a flow of ink through the nozzle orifices so as to resolve an ink ejection failure that is caused by the clogging of the nozzle orifices due to the solidification of ink, or due to air bubbles that have entered an ink channel.

The forcible ink suction and discharge process, which is performed to prevent the clogging of the recording head or the entry of air bubbles into an ink channel, is normally called a cleaning operation. The cleaning operation is begun when printing is restarted after the apparatus has been halted for a long time, or when a user manipulates a cleaning switch to resolve the degrading of the quality of a recorded image. For this process, ink droplets are drawn out through the nozzle orifices by the application of a negative pressure, and a cleaning member, constituted by an elastic rubber plate, wipes the surface of the recording head.

In this type of recording apparatus, the capping member and the cleaning member are located at the end of the path along which the carriage is moved, and when the carriage has been moved to the end (home position), the face of the recording head wherein the nozzle orifices are formed can be sealed by the capping member.

Further, in a recording apparatus of this type, a black ink cartridge and color ink cartridges are prepared for supplying ink to the black recording head and to the color recording heads. A common recording apparatus of this type is so designed that individual cartridges can be attached to and removed from a carriage on which the recording heads are mounted.

When, for example, an ink cartridge of the above described recording apparatus has been emptied and is to be replaced, it is employed a control method to move the carriage to a position other than the home position. This is done in order to avoid the following problems. If the ink cartridge can be replaced while the recording head is sealed by the capping member, the undesirable removal of an ink cartridge that has not yet been emptied can be easily performed. Further, the force exerted when an ink cartridge is exchanged adversely affects the capping member, resulting in an increase in the pressure in the sealing cap that destroys an ink meniscus in the nozzle and results in a printing failure.

Therefore, a recording apparatus is provided which is so designed that, in the casing body accommodating the recording device, an opening for exchanging ink cartridges is formed at a position other than the home position, whereat the capping member is located, and when ink cartridges are to be replaced, a carriage is moved to the exchange opening.

In, for example, Japanese Patent Publication No. 9-70962A, there is disclosed the structure of a recording apparatus wherein an exchange opening is formed in a casing body. According to this recording apparatus, when the printer cover at the top of the casing body is opened, this action is detected and the carriage is moved to the exchange opening.

Furthermore, in Japanese Patent No. 2716891, there is disclosed a structure wherein an exchange opening is formed in a casing body containing the main body of a recording apparatus. According to this recording apparatus, the carriage is moved to the exchange opening upon the manipulation of an operating key that releases the printer cover and that places the apparatus in an ink cartridge exchange mode.

However, according to the first related recording apparatus, each time the cover at the top of the casing body is opened during printing, the printing process is halted and the carriage is moved to and halted at the exchange opening. Throughput is therefore reduced.

Further, according to the second related recording apparatus, the operating key for releasing the cover and for placing the apparatus in the ink cartridge exchange mode must be manipulated in order to exchange ink cartridges, thus rendering the exchange job complex and providing usability that is less than excellent. In addition, whenever erroneous manipulation of the operating key occurs the printing process is halted and the carriage is moved to and halted at the exchange opening, and throughput is reduced, as in the first related art.

SUMMARY OF THE INVENTION

To resolve the above shortcomings, it is one objective of the present invention to provide an ink jet recording apparatus having excellent operability in which a carriage can be automatically move toward an exchange opening when, for example, ink cartridges must be replaced.

In order to achieve the above object, there is provided an ink jet recording apparatus comprising: an ink jet recording unit including a recording head having nozzle orifices from which ink drops are ejected, an ink cartridge for supplying ink to the recording head, and a carriage on which the recording head and the ink cartridge are mounted and being moved in a width direction of a recording sheet; a casing body for accommodating the ink jet recording unit, the casing body having an opening formed along a part of path on which the carriage is moved in order to exchange the ink cartridge therethrough, and a cover member being closed to cover the opening and being opened to expose the opening; ink end detection means for detecting the ink end of the ink cartridge; cover state detection means for detecting whether the cover member is opened; and carriage control means for controlling a position of the carriage so as to move toward the opening when the ink end detection means detects that ink has been exhausted and when the cover state detection means detects that the cover member is opened.

The apparatus further comprises capping means for sealing a surface of the recording head on which the nozzle orifices are formed and for drawing ink out through the nozzle orifices by the application of negative pressure generated by negative pressure generating means. The opening may be situated other than a home position whereat the capping means are provided.

In the apparatus, the ink end detection means may include cartridge detection means for detecting whether the ink cartridge is mounted on the carriage, and counting means for counting the amount of ink ejected by the recording head which is reset when the cartridge detection means detects that a new ink cartridge is mounted. The ink end detection means determines that the ink has been exhausted when a value held by the counting means reaches a predetermined count.

Alternatively, it may be configured that the ink end detection means detects conductivity in the ink cartridges through electrodes embedded therein, and makes a determination that the ink has been exhausted based on the detected conductivity.

In the apparatus, the carriage control means may move the carriage toward the home position when the cover state detection means detects that the cover member is closed.

The apparatus may further comprise cleaning control means for driving the negative pressure generating means to apply the negative pressure into the capping means which seals the surface of the recording head on which the nozzle orifice are formed. The cleaning control means is activated when the cover state detection means detects that the cover member is closed and the cartridge detection means detects that a new ink cartridge has been mounted on the carriage.

In the apparatus, the cartridge detection means may have a flag indicating whether the ink cartridge is mounted on the carriage, which is turned into ON state when the ink cartridge is removed from the carriage, and is returned into OFF state after the cleaning operation for the new ink cartridge is terminated.

The apparatus may further comprise: instruction input means operated by an operator for inputting an instruction to exchange the ink cartridge; and operation detection means for detecting an operation state of the instruction input means. The carriage control means moves the carriage toward the opening when the operation detection means detects that the instruction input means is operated for a predetermined time period or longer.

According to the present invention, there is also provided an ink jet recording apparatus comprising an ink jet recording unit including a recording head having nozzle orifices from which ink drops are ejected, an ink cartridge for supplying ink to the recording head, and a carriage on which the recording head and the ink cartridge are mounted and being moved in a width direction of a recording sheet; a casing body for accommodating the ink jet recording unit, the casing body having an opening formed along a part of path on which the carriage is moved in order to exchange the ink cartridge therethrough, and a cover member being closed to cover the opening and being opened to expose the opening; instruction input means operated by an operator for inputting an instruction to exchange the ink cartridge; operation detection means for detecting an operation state of the instruction input means; and carriage control means for controlling a position of the carriage so as to move toward the opening when the operation detection means detects that the instruction input means has been operated for a predetermined period or longer.

The apparatus may further comprise cover state detection means for detecting whether the cover member is opened. When the cover state detection means detects that the cover member is opened while the carriage is moving, the movement of the carriage is halted.

According to the present invention, there is also provided an ink jet recording apparatus comprising: an ink jet recording unit including a recording head having nozzle orifices from which ink drops are ejected, an ink cartridge for supplying ink to the recording head, and a carriage on which the recording head and the ink cartridge are mounted and being moved in a width direction of a recording sheet; a casing body for accommodating the ink jet recording unit, the casing body having an opening formed along a part of path on which the carriage is moved in order to exchange the ink cartridge therethrough, and a cover member being closed to cover the opening and being opened to expose the opening; instruction input means operated by an operator for inputting an instruction to exchange the ink cartridge; operation detection means for detecting an operation state of the instruction input means; cover state detection means for detecting whether the cover member is opened; and carriage control means for controlling a position of the carriage so as to move toward the opening when the operation detection means detects that the instruction input means has been operated for a predetermined time period or longer, and the cover state detection means detects that the cover member is opened.

The above apparatuses may further comprise alarm means to be driven when the operation detection means detects that the instruction input means has been manipulated for the predetermined time or longer.

In the apparatus, audio alarm means, visual alarm means or means for generating an alarm by driving a mechanical part of the apparatus is employed as the alarm means.

In the apparatus, the recording head and the ink cartridge in the ink jet recording unit may be separately provided. Alternatively, the head and the cartridge may be integrally provided.

In the thus arranged ink jet recording apparatus, when the ink end detection means detects that the ink in an ink cartridge has been exhausted, and when the cover member is opened, the carriage is automatically moved to the exchange opening that is formed in the casing body. As a result, the ink cartridge mounted on the carriage located at the opening can be exchanged.

In this casing body, since the opening for exchanging ink cartridges is located at a position other than the home position whereat the capping means is provided, the erroneous removal or insertion of an ink cartridge is prevented when the recording heads are sealed by the capping means. Thus, the destruction of an ink meniscus due to an increase in pressure in a cap does not occur, and a printing failure can be prevented.

When the cover member on the casing body is closed, the carriage is moved to the home position in accordance with a signal produced by the cover state detection means, and the nozzle formation face of the recording head is sealed by the capping means Furthermore, when the ink cartridge detection means detects that an ink cartridge is attached to the carriage, the negative pressure generating means is driven to draw out ink. As a result, the ink suction operation can be performed that is requested following an exchange of ink cartridges, and air bubbles in the recording head can be discharged.

DETAILED DESCRIPTION OF THE PREFERRED EMBODIMENTS

Figure 1:
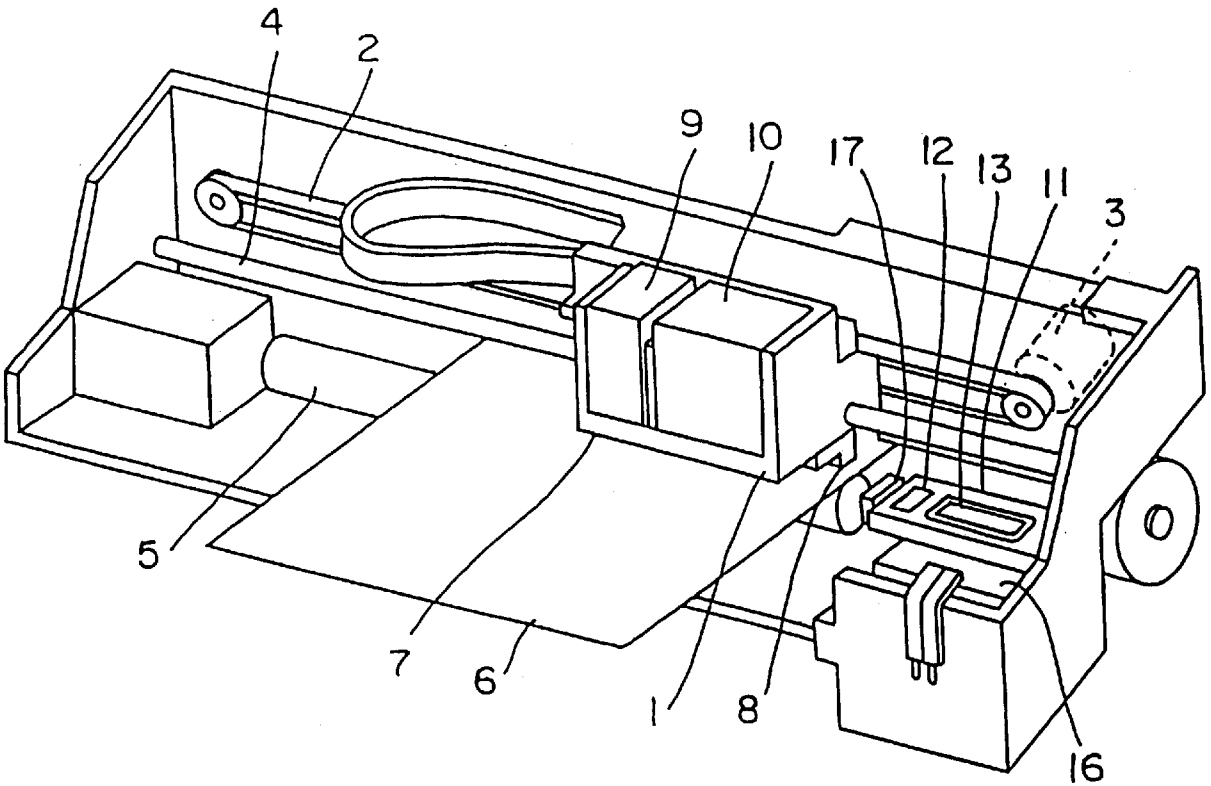
FIG. 1 is a perspective view of the main body of an ink jet recording apparatus for which the present invention is applied.

An ink jet recording apparatus according to the present invention will now be described by referring to the accompanying drawings. FIG. 1 is a perspective view of the overall arrangement of the ink jet recording apparatus for which the present invention is applied. In FIG. 1, a carriage 1, propelled by a timing belt 2 that is driven by a carriage motor 3, reciprocates along a guide member 4 in the axial direction of a platen 5.

A black recording head 7 and a color recording head 8 are mounted on the side of the carriage 1 opposite a recording sheet 6, and a black ink cartridge 9 and a color ink cartridge 10 are detachably mounted on the top of the carriage 1 to supply ink to the individual recording heads 7 and 8.

A capping member 11 is located at a printing unavailable area (home position). A cap unit 12 for a black recording head and a cap unit 13 for a color recording head are provided on the capping member 11. A suction pump 16 is located under the capping member 11 for exerting a negative pressure on the capping member 11.

The cap units 12 and 13 serve as lids to prevent the nozzle orifices from drying when the recording apparatus is not in use, and they also serve as ink receivers during a flushing operation in which a drive signal unrelated to printing is transmitted to the recording heads for the ejection of ink droplets. Furthermore, the cap units 12 and 13 serve as means for applying negative pressure, produced by the suction pump 16, to the recording heads 7 and 8 to draw out ink.

A cleaning member 17 comprised of an elastic plate, such as a rubber plate, is located in the printing available area at the capping member 11. When the carriage 1 is moved toward the capping member 11, the cleaning member 17 wipes the nozzle plates of the recording heads 7 and 8.

Figure 2:
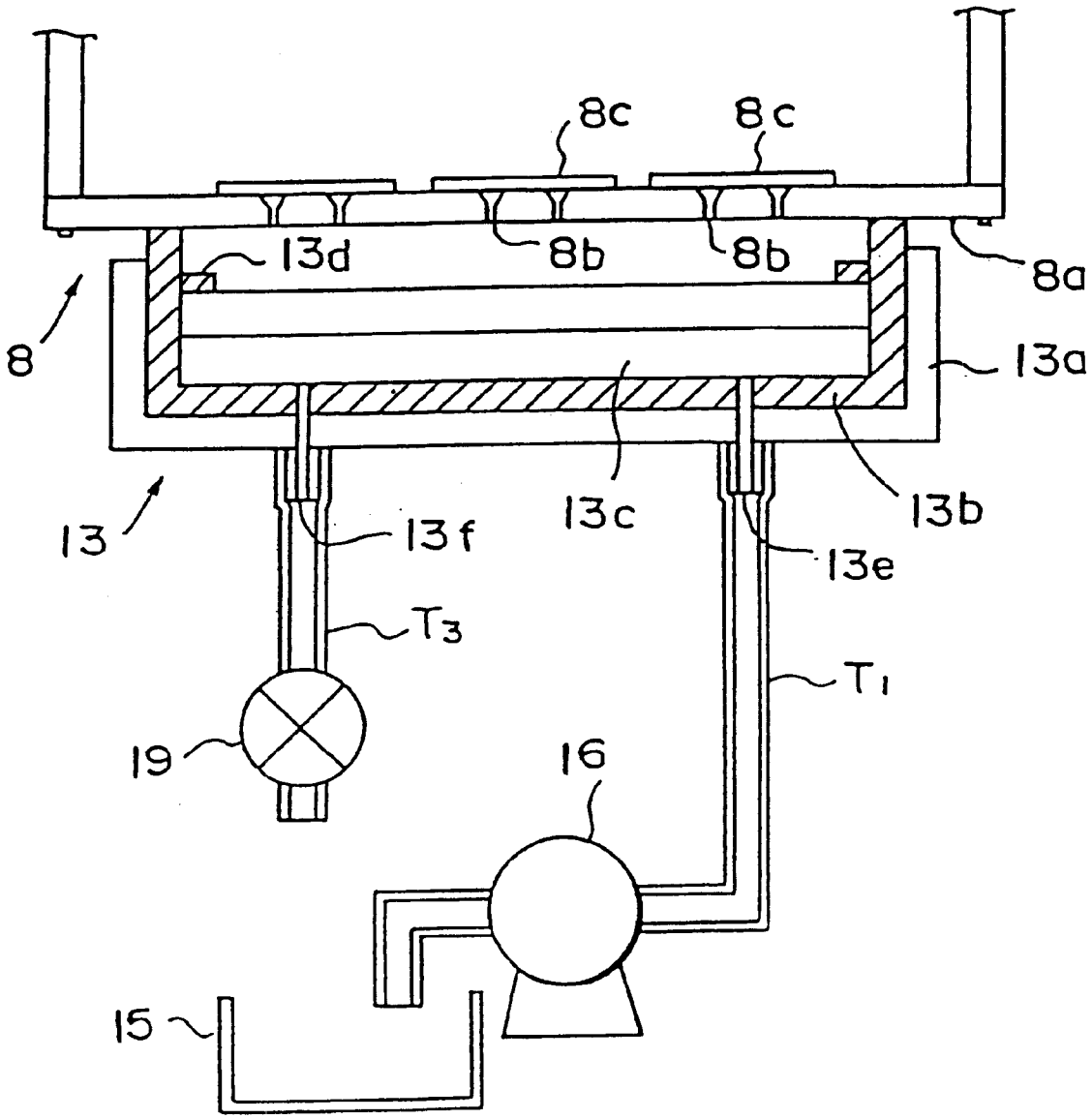
FIG. 2 is a cross-sectional view showing a cap unit mounted in the recording apparatus of FIG. 1 and peripheral devices thereof.

FIG. 2 is a specific diagram showing the structure of one of the cap units 12 and 13, the cap unit 13, for example, for colored ink, and the suction pump 16 that is connected thereto. The same structure as explained below is also employed for the cap unit 12 for black ink.

The cap unit 13 includes a rectangular cap casing 13*a* with an open top, and a cap 13*b* composed of a flexible material, such as rubber, that is stored in and projects slightly above the upper edge of the cap casing 13*a*. An ink absorption member 13*c* composed of a porous material is internally retained at the bottom of the cap member and is held in place by holders 13*d*, which are integrally formed with the cap 13*b*.

A suction hole 13*e* and an air hole 13*f* are formed in the bottom of the cap casing 13*a* and penetrate the cap casing 13*a* and the cap 13*b*.

The suction pump 16 is connected to the suction hole 13*e* of the cap casing 13*a* via a tube T1, and a waste ink tank 15 is provided on the discharge side of the suction pump 16. An air valve 19 is connected to the air hole 13*f* of the cap casing 13*a* via a tube T3.

A colored ink recording head 8 in FIG. 2 is so designed that, when the cap unit 13 is moved upward, the surface of a nozzle plate 8*a* is capped by the cap unit 13. Formed in the nozzle plate 8*a* are nozzle orifices 8*b* through which colored inks, yellow, cyan and magenta, can be ejected by piezoelectric vibrators 8*c* that are located adjacent to the nozzle orifices 8*b*.

With the above arrangement, the ink suction and discharge operation is performed for discharging air bubbles in the recording heads and for eliminating the clogging of the nozzle orifices while, as in FIG. 2, the cap 13*b* is held in close contact with the nozzle plate 8*a* of the recording head 8, and the air valve 19 is open.

Specifically, when the suction pump 16 is operated under the above conditions, a negative pressure is applied in the internal space of the cap 13*b* and ink is discharged from the nozzle orifices 8*b*. When, as ink is discharged, the negative pressure inside the cap 13*b* is reduced a little and the air valve 19 is opened, air is introduced into the cap 13*b* and the internal negative pressure is dissipated.

When the suction pump 16 is again activated with the air valve 19 open, ink discharged to the cap 13*b* is conveyed through the tube T1 to the waste ink tank 15.

Figure 3:
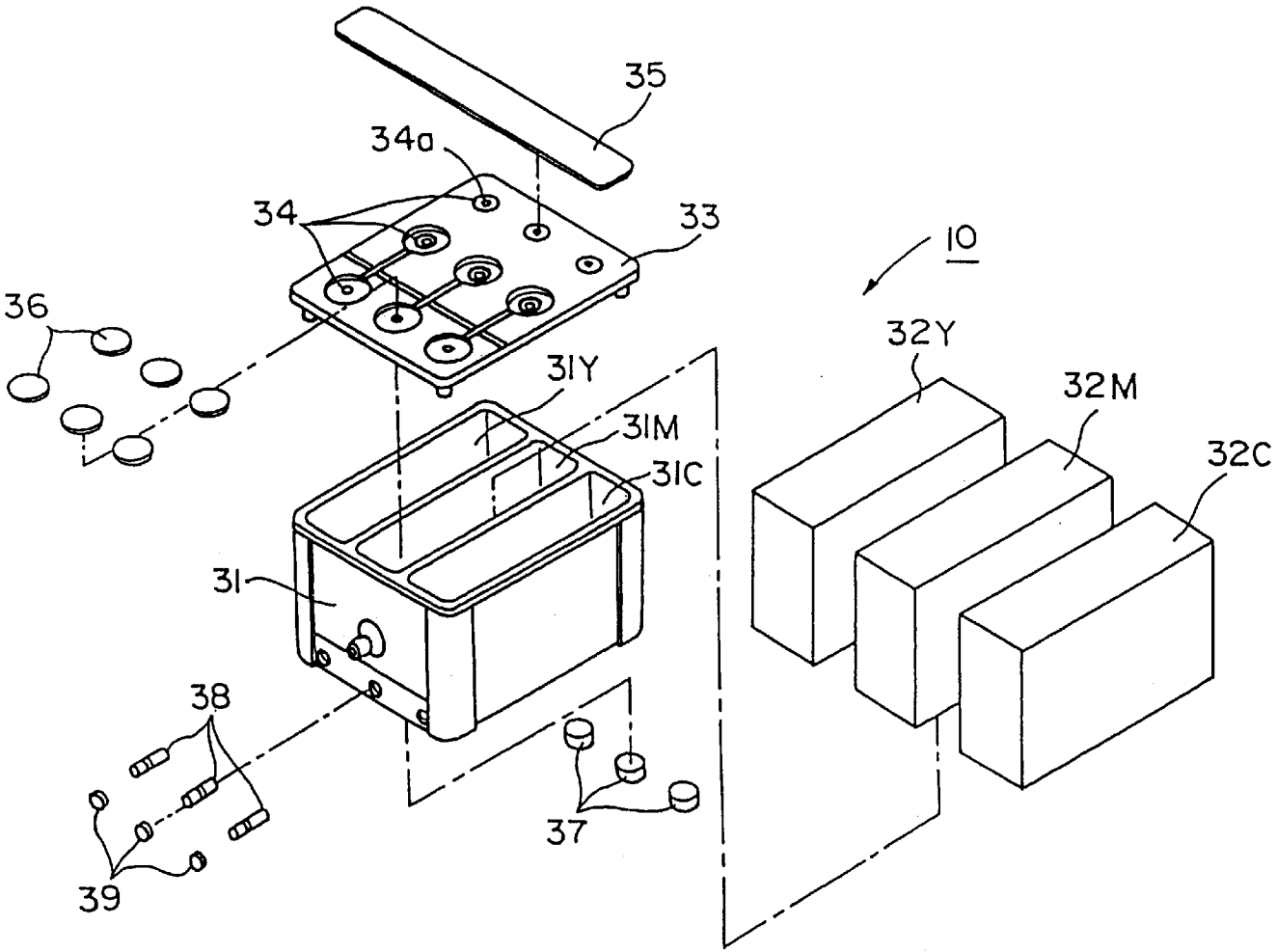
FIG. 3 is an exploded perspective view showing an ink cartridge to be mounted in the recording apparatus of FIG. 1.

FIG. 3 is a diagram showing the arrangement of an ink cartridge that is attached to the top of the recording heads mounted on the carriage 1. In the example in FIG. 3, a color ink cartridge 10 that is filled with yellow, magenta and cyan inks is employed. A black ink cartridge 9 that is filled with black ink has substantially the same structure as the color ink cartridge 10 which will be described below, with the exceptions that it is not as wide and that it has only one ink reservoir.

The color ink cartridge 10 is basically constituted by a box-shaped ink tank 31 that, for example, is made of polypropylene; porous foams 32Y, 32M and 32C, which are stored in the ink tank 31 and which are impregnated with ink; and a lid 33 that covers the top of the ink tank 31.

The ink tank 31 is divided into three chambers 31Y, 31M and 31C in which are stored the quadrilateral-shaped foams 32Y, 32M and 32C, which are composed of a porous material such as polyurethane foam. The individual chambers are filled with yellow, magenta and cyan inks.

In the lid 33 that covers the top of the ink tank 31, formed for each chamber are three through holes 34, for communicating with the outside. Reusable sealing tape 35 is at least affixed to through holes 34*a*, provided for each of the individual chambers. The through holes 34 are closed by the sealing tape 35 until immediately before they are employed. And when the through holes 34 are opened for use, they perform their intended functions.

Since the sealing tape 35 shown in FIG. 3 is especially employed, all the through holes 34*a* for the individual chambers can be opened at one time when the sealing tape 35 is peeled off by grasping it at the end. In this casing body, it is preferable that one end of the sealing tape 35 be connected to the packaging (not shown) for the cartridge 10, and that the sealing tape 35 be peeled off when the cartridge 10 is removed from the package.

After the sealing tape 35 is peeled off and is then attached to the recording apparatus, consonant with the ink that is consumed, air is loaded into the ink cartridge 10 via the through holes 34*a*.

The other through holes 34 are closed by independent sealing members 36. Moisture-vapor transmission by these sealing members 35 and 36 occurs at a predetermined level or lower, and gas transmission by at least one of the sealing members 35 and 36 occurs at a predetermined level or higher. Thus, the leakage of ink is prevented during the shipping of ink cartridges, and ink is degassed again after ink cartridges are decompressed and packaged.

A cylindrical ink chamber (not shown) is formed at the bottom of each of the chambers 31Y, 31M and 31C. These ink chambers are closed by fitting into their ends sealing members 37 composed of an elastic material, such as rubber, and by a sealing member (not shown).

As a thus arranged ink cartridge 10 is loaded into a printer, each of the sealing members 35 and 36 is pierced by a hollow needle (not shown) that communicates with the recording head 8, and are secured to the sealing member 37 by an airtight bond, so that ink from the ink cartridge 10 can be introduced into the recording head 8.

Electrodes 38 for determining when the supply of ink has been exhausted are embedded in the side of the ink tank 31, so that the distal ends of the electrodes 38 contact the foams 32Y, 32M and 32C in the chambers 31Y, 31M and 31C. The electrodes 38 are closed by O-rings 39 to prevent the leakage of ink. Determining when the supply of ink has been exhausted is effected by measuring the electric resistance (conductivity) between the electrodes 38 and the hollow needles.

Figure 4:
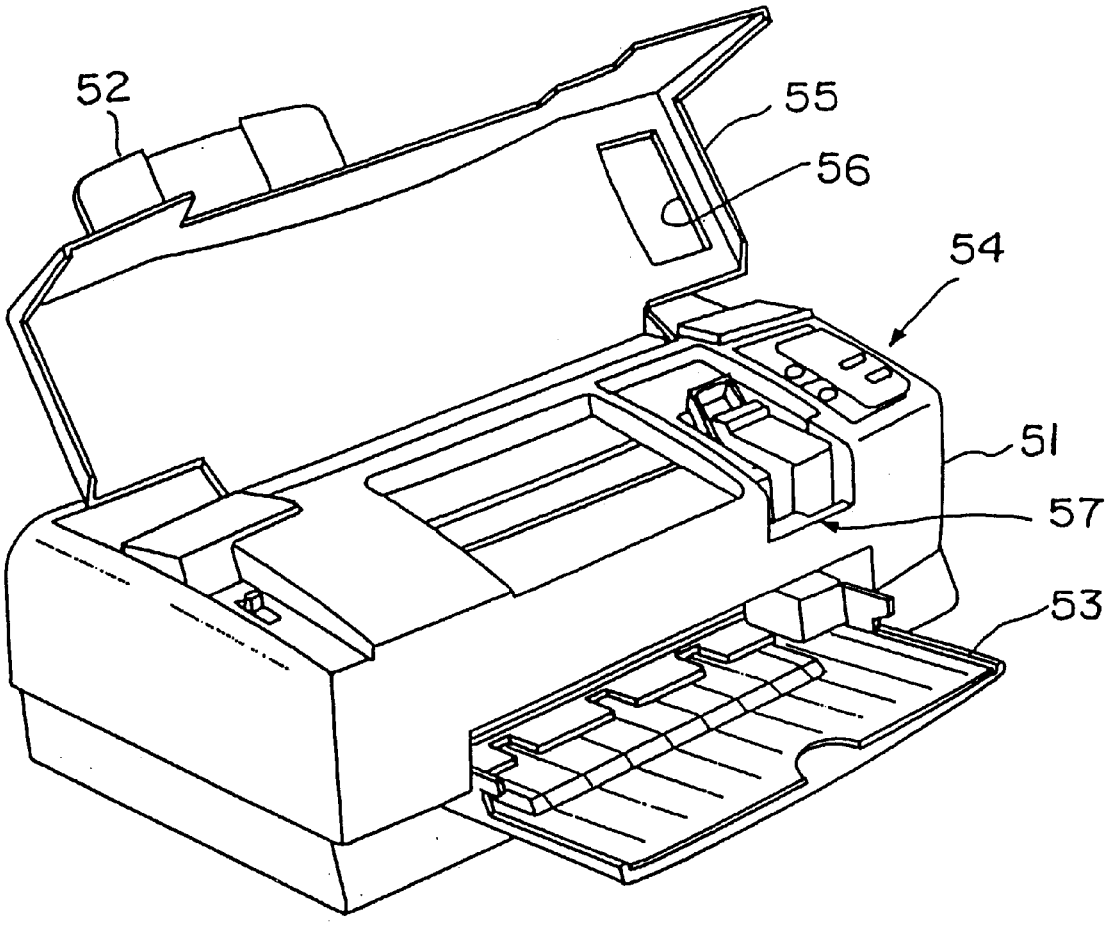
FIG. 4 is a perspective view showing an outlook of a casing body in which the main body of the recording apparatus of FIG. 1 is accommodated.

The thus structured main unit of the recording apparatus is placed in a casing body having the shape shown in FIG. 4, for example. For a casing body 51, a paper feeding tray 52 is provided at the rear and a paper discharge tray 53 is provided at the front. On the upper right face of the casing body 51 is provided a panel 54, on which operating keys are arranged as instruction input means, to include a cleaning instruction switch 66 and a forcible moving switch 72, which will be described later.

A lid (also called a printer cover) for covering the top of the casing body 51 is attached by hinges (not shown) so that it can be opened and closed from the front of the apparatus. A window hole 56 is formed in the printer cover 55, so that a power switch and a paper feeding/discharge switch on the panel 54 are exposed when the cover 55 is closed.

When the printer cover 55 is opened, an opening 57 for the exchanging of ink cartridges, etc., is exposed. The opening 57 is formed at a position other than a home position whereat the capping member 11 is located.

A switch (not shown) that is turned on or off interlocking with the opening and closing of the printer cover 55 is provided inside the casing body 51, and the ON/OFF state of the switch is transmitted to the host computer of the recording apparatus that will be described later.

Figure 5:
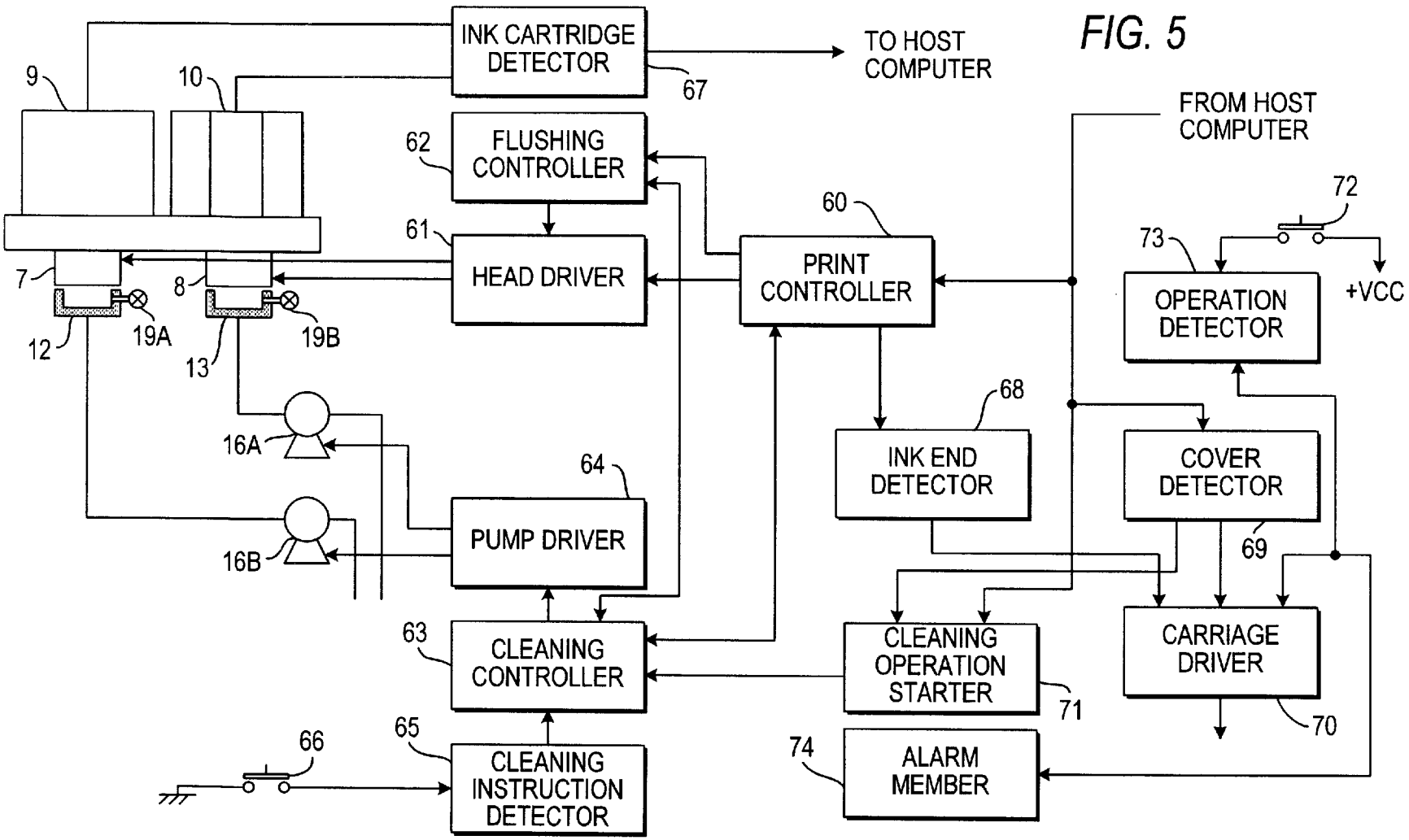
FIG. 5 is a block diagram illustrating an example control circuit mounted in the ink jet recording apparatus of the present invention.

FIG. 5 is a diagram showing a control circuit mounted in the thus structured recording apparatus. In FIG. 5, the same reference numerals are used to denote the recording heads 7 and 8, the ink cartridges 9 and 10, the cap units 12 and 13, the suction pump 16 and the valve unit 19 that were previously described, and no explanation for them will be given. In FIG. 5, two suction pumps 16A and 16B and two valve units 19A and 19B are employed.

In FIG. 5, a print controller 60 generates bit map data based on print data received from the host computer of the recording apparatus, uses the bit map data to generate a drive signal, and permits a head driver 61 to generate a drive signal, based on the bit map data, and to eject ink from the recording heads 7 and 8. Upon receiving not only a drive signal that was produced based on the print data, but also a flushing command signal from a flushing controller 62, the head drive means 6 outputs to the recording heads 7 and 8 a drive signal for a flushing operation.

Upon receiving a command from a cleaning controller 63, operation of a pump driver 64 is begun to drive the suction pumps 16A and 16B. Meanwhile, the cleaning controller 63 receives a cleaning command signal from the print controller 60, a cleaning command detector 65 and a cleaning operation starter 71.

A command switch 66 is connected to the cleaning command detector 65. Thus, when a user, for example, manually depresses the switch 66, the command detecting section 65 is activated and executes the cleaning operation.

An ink cartridge detector 67 is so designed that a switch (not shown) for determining whether the ink cartridge is attached is provided for the cartridge holder of the carriage 1, and so that a signal from the switch is transmitted to the host computer.

An ink end detector 68 receives, from the print controller 60, data corresponding to the amount of ink ejected by the recording head, and also receives status data from the host computer. The ink end detector 68 sets a cartridge detachment flag (ON state) upon detecting the removal of an ink cartridge, and resets the cartridge detachment flag (OFF state) upon detecting the insertion of an ink cartridge.

Therefore, when an ink cartridge is exchanged, the status of the cartridge detachment flag is changed from ON to OFF. Therefore, that an ink cartridge has been replaced is ascertained by detecting this change, and the counter in the ink end detector 68 is then reset.

Subsequently, based on succeeding data that are received from the print controller 60 and that correspond to the amount of ejected ink, the ink end detector 60 increments the value held by the counter that reflects the amount of ink that has been ejected by the cartridge. When the counted value reaches a predetermined value, it is ascertained that ink in the ink cartridge has been exhausted, and in accordance with this condition, an ink end flag is set (ON state) and its state is transmitted to a carriage driver 70, which will be described later.

The ink end detection process can be realized by not only the above described software means but also hardware means. For example, as explained in FIG. 3, the conductivity may be measured between the ink end detection electrodes 38 embedded in the ink cartridge 10 and the hollow needle that is used to supply to the recording head 8 ink obtained from the ink cartridge 10, and the ink end state may be ascertained in accordance with the obtained conductivity.

The host computer transmits the status data to a cover detector 69. The cover detector 69 employs the status data to determine whether the cover 55 in FIG. 4 is open or closed, and transmits the state of a cover state flag associated with the status data to the carriage driver 70 and to the cleaning operation starter 71.

The carriage driver 70, as is described above, also receives the state of the ink end flag from the ink end detector 68. When the state of the ink end flag received from the ink end detector 68 indicates the flag is ON (the ink end state), and when the state of the cover state flag received from the cover detector 69 indicates that flag is also ON (the printer cover 55 is open), the carriage driver 70 transmits a command signal to a control system, which includes the carriage motor 3, in order to move the carriage 1 and to position it at the opening 57 formed in the casing body 51 for the exchange of ink cartridges.

Thus, a user can remove the ink cartridge in which the ink is exhausted through the opening 57 in the casing body 51, and can load a new ink cartridge therein. After the ink cartridges have been exchanged, in accordance with a signal received from the cartridge detector 67, the ink end detector 68 resets the internal counter, and in accordance with data that are again received from the print controller 60 and that correspond to the amount of ink to be ejected, increments the value for the volume of ink to be ejected by the ink cartridge.

In this casing body, if the printer cover 55 is closed without the ink cartridges being exchanged, the state of the cover state flag that indicates the flag has been reset (OFF state) is transmitted by the cover detector 69 to the carriage driver 70. Therefore, the carriage driver 70 transmits a command signal to the control system, which includes the carriage motor 3, to move the carriage 1 to the home position. As a result, the recording head is closed by the cap unit.

Similarly, if the printer cover 55 is closed after the ink cartridges have been exchanged, the state of the cover state flag that indicates the flag has been reset (OFF state) is also transmitted by the cover detector 69 to the carriage driver 70. Therefore, as above, the carriage driver 70 transmits a command signal to the control system, which includes the carriage motor 3, to move the carriage 1 to the home position. As a result, in this casing body also the recording head is closed by the cap unit.

A signal indicating that the cover state flag has been reset is also transmitted to the cleaning operation starter 71. Also, the cleaning operation starter 71 employs the status of the cartridge detachment flag, which is received from the host computer, to determine whether an ink cartridge is mounted on the carriage 1. Therefore, the cleaning operation starter 71 transmits a command signal to the cleaning controller 63 which then begins a cleaning operation.

During the cleaning operation, one or both of the suction pumps 16A and 16B are driven to draw out and to discharge ink through the nozzle orifices of the recording head. In this manner, air bubbles that entered the recording head when the ink cartridge was connected to the ink supply needle are discharged, and normal printing is ensured.

In the above embodiment, the cartridge detachment flag is set (ON state) when an ink cartridge is removed from the carriage, and is reset (OFF state) when an ink cartridge is mounted on the carriage. With such control method, if the apparatus is powered off immediately after the ink cartridge is exchanged, the cartridge detachment flag is reset but the cleaning operation is not performed to remove air bubbles that entered the ink channel extending from the ink cartridge to the recording head. Therefore, when the apparatus is turned on the next time, the condition for executing the cleaning operation is not satisfied and a printing failure may occur.

Therefore, it is preferable that an exchange-cleaning flag be set when the ink cartridge is removed from the carriage, and that the exchange-cleaning flag be reset after the cleaning controller 63 has completed the operation for drawing ink out through the nozzle orifices of the recording head.

With this arrangement, even when the apparatus is powered off immediately after an ink cartridge is exchanged, the exchange-cleaning flag is still ON state. And thus, when the device is again powered on, the cleaning operation will be automatically performed so that air bubbles are removed from the ink channel extending from the ink cartridge to the recording head, and so that the printing quality is ensured.

Referring again to FIG. 5, the forcible moving switch 72 is provided as instruction input means for the recording apparatus. A control voltage is applied to an operation detector 73 by depressing the switch 72. The operation detector 73 transmits a command signal to the carriage driver 70 only when the switch 72 has been continuously depressed for a period of from 3 to 5 seconds, for example.

Upon the depression of the switch 72, the carriage driver 70 transmits a command signal to the control system, which includes the carriage motor 3, to move the carriage 1 and to position it at the opening 57 formed in the casing body 51 for the exchange of components. Therefore, under these conditions the ink cartridge, as well as the unit constituted by the recording head and the cartridge, can be exchanged.

Since the carriage is forcibly moved only after the switch 72 has been continuously depressed for from 3 to 5 seconds, a user is fully cognizant that the switch has been depressed, and an erroneous operation occasioned by the user mistakenly touching the switch 72 can be prevented.

Further, a command signal is also transmitted by the operation detector 73 to an alarm member 74, which can be an audio alarm, such as a buzzer. The alarm member 74 is activated by the continuous depression of the switch 72 for from 3 to 5 seconds, and is used to notify a user that the carriage 1 is to be forcibly moved and positioned at the opening 57 in the casing body 51. A visual alarm, such as by blinking an LED, may also be used as the alarm member 74.

Furthermore, a part of a mechanism in the recording apparatus may be driven and used as the alarm. In this casing body, a command signal is transmitted by the operation detector 73 to the carriage driver 70. Upon receiving this signal, the carriage driver 70 transmits a command signal to the control system, which includes the carriage motor 3, to move the carriage 1 back and forth a short distance in each direction. In this manner, the user is notified that the carriage 1 is to be forcibly moved and positioned at the opening 57 in the casing body 51.

In a recording apparatus wherein, for example, a large opening is formed for exchanging ink cartridges, etc., if the carriage 1 is moved and positioned at the opening 57 while the printer cover 55 is open, a user may touch the moving carriage 1 by accident.

Therefore, when the carriage 1 is being moved in order to position the same at the opening 57 in the casing body 51, and a signal indicating that the cover state flag is ON state (printer cover 55 is open) is transmitted by the cover detector 69 to the carriage driver 70, it is preferable that the carriage driver 70 halt the movement of the carriage 1.

That is, it is preferable that only when the logical product of a forcible moving signal, obtained from the operation detector 73, and the state of the cover state flag, obtained from the cover detector 69, indicates the OFF state (the printer cover 55 is closed) will the carriage driver 70 in FIG. 5 forcibly move the carriage 1 and position it at the opening 57. Since such control method is employed, the shifting of the carriage 1 can be halted when the printer cover 55 is opened, so that the possibility that a user will sustain an injury by accidentally touching the moving carriage 1 can be prevented.

When the above described control method is employed for halting the movement of the carriage 1 at the time the printer cover 55 is opened, a condition may be established wherein the recording head is not closed by the capping member if the printer cover 55 remains open, and accordingly, deterioration of the printing reliability may occur.

Therefore, with a recording apparatus other than one that has the larger opening 57 formed for the exchange of ink cartridges, it can be determined that as the instruction input means, the forcible moving switch 72 has been continuously manipulated for a predetermined period of time or longer, and the carriage 1 can be moved and positioned at the opening 57 when the cover detector 69 determines that the lid is open.

Specifically, when the logical product of a forcible moving signal, obtained from the operation detector 73, and the state of the cover state flag, obtained from the cover detector 69, indicates the ON state (the printer cover 55 is open), the carriage driver 70 in FIG. 5 forcibly moves the carriage 1 and positions it at the opening 57.

With this arrangement, after a user ascertains that the printer cover 55 is open, i.e., after the user has determined that forcible shifting of the carriage 1 is pending, the movement of the carriage 1 is initiated.

In the explanation of the above embodiment, whether or not the printer cover at the top of the casing body is open is determined, and based on the result, the carriage is moved and positioned at the opening. However, it is also effective to provide a forcible moving switch 72 for a recording apparatus that has no printer cover.

That is, in the arrangement wherein forcible movement of the carriage is initiated by the continuous depression of the switch 72 for from 3 to 5 seconds, the carriage 1 is moved and is positioned at the opening 57 formed in the casing body 51. Thus, the ink cartridge, as well as the unit constituted by the recording head and the ink cartridge, can be exchanged.

As is described above, according to the present invention, the ink jet recording apparatus comprises: the ink end detector for detecting when the ink in each of the cartridges mounted on the carriage is exhausted; and cover detector for detecting whether the cover member attached to the casing body is open. And when the ink end detector detects the ink is exhausted, and the cover detector detects that the cover member is open, the carriage is moved and is positioned at the opening. Therefore, the operability relative to the exchange of ink cartridges when the ink has been exhausted can be improved.

When the cover detector detects that the cover member is closed, the carriage is moved to the home position. When the ink cartridge detector detects that an ink cartridge has been mounted, the cleaning operation for drawing ink out through the nozzle orifices -of the recording head is automatically performed. Therefore, the operability after the ink cartridges have been exchanged can be improved, and an ink jet recording apparatus that is easy to handle and is reliable can be provided.

What is claimed is:

1. An ink jet recording apparatus, comprising:

an ink jet recording unit including a recording head having nozzle orifices from which ink drops are ejected, an ink cartridge for supplying ink to the recording head, and a carriage on which the recording head and the ink cartridge are mounted and being moved in a width direction of a recording sheet;

a casing body for accommodating the ink jet recording unit and for covering a cavity in which the recording head and ink cartridge are placed, the casing body having an opening smaller than the cavity formed along a part of path on which the carriage is moved in order to exchange the ink cartridge therethrough, and a cover member being closed to cover the opening and being opened to expose the opening;

ink end detection means for detecting the ink end of the ink cartridge;

cover state detection means for detecting whether the cover member is opened; and carriage control means for controlling a position of the carriage so as to move toward the opening when the ink end detection means detects that ink has been exhausted and when the cover state detection means detects that the cover member is opened.

2. The ink jet recording apparatus as set forth in claim 1, further comprising:

capping means for sealing a surface of the recording head on which the nozzle orifices are formed and for drawing ink out through the nozzle orifices by the application of negative pressure generated by negative pressure generating means, wherein the opening is situated other than a home position whereat the capping means are provided.

3. The ink jet recording apparatus as set forth in claim 1, wherein the ink end detection means includes cartridge detection means for detecting whether the ink cartridge is mounted on the carriage, and counting means for counting the amount of ink ejected by the recording head which is reset when the cartridge detection means detects that a new ink cartridge is mounted, wherein the ink end detection means determines that the ink has been exhausted when a value held by the counting means reaches a predetermined count.

4. The ink jet recording apparatus as set forth in claim 1, wherein the ink end detection means detects conductivity in the ink cartridges through electrodes embedded therein, and makes a determination that the ink has been exhausted based on the detected conductivity.

5. The ink jet recording apparatus as set forth in claim 2, wherein the carriage control means moves the carriage toward the home position when the cover state detection means detects that the cover member is closed.

6. The ink jet recording apparatus as set forth in claim 2, further comprising:

cleaning control means for driving the negative pressure generating means to apply the negative pressure into the capping means which seals the surface of the recording head on which the nozzle orifice are formed, the cleaning control means activated when the cover state detection means detects that the cover member is closed and the cartridge detection means detects that a new ink cartridge has been mounted on the carriage.

7. The ink jet recording apparatus as set forth in claim 6, wherein the cartridge detection means has a flag indicating whether the ink cartridge is mounted on the carriage, which is turned into ON state when the ink cartridge is removed from the carriage, and is returned into OFF state after the cleaning operation for the new ink cartridge is terminated.

8. The ink jet recording apparatus as set forth in claim 1, further comprising:

instruction input means operated by an operator for inputting an instruction to exchange the ink cartridge; and operation detection means for detecting an operation state of the instruction input means, wherein the carriage control means moves the carriage toward the opening when the operation detection means detects that the instruction input means is operated for a predetermined time period or longer.

9. An ink jet recording apparatus, comprising:

an ink jet recording unit including a recording head having nozzle orifices from which ink drops are ejected, an ink cartridge for supplying ink to the recording head, and a carriage on which the recording head and the ink cartridge are mounted and being moved in a width direction of a recording sheet;

a casing body for accommodating the ink jet recording unit and for covering a cavity in which the recording head and ink cartridge are placed, the casing body having an opening smaller than the cavity formed along a part of path on which the carriage is moved in order to exchange the ink cartridge therethrough, and a cover member being closed to cover the opening and being opened to expose the opening;

instruction input means operated by an operator for inputting an instruction to exchange the ink cartridge;

operation detection means for detecting an operation state of the instruction input means; and carriage control means for controlling a position of the carriage so as to move toward the opening when the operation detection means detects that the instruction input means has sustained the operation state for at least a predetermined time period.

10. The ink jet recording apparatus as set forth in claim 9, further comprising:

cover state detection means for detecting whether the cover member is opened, wherein when the cover state detection means detects that the cover member is opened while the carriage is moving, the movement of the carriage is halted.

11. An ink jet recording apparatus, comprising:

an ink jet recording unit including a recording head having nozzle orifices from which ink drops are ejected, an ink cartridge for supplying ink to the recording head, and a carriage on which the recording head and the ink cartridge are mounted and being moved in a width direction of a recording sheet;

a casing body for accommodating the ink jet recording unit and for covering a cavity in which the recording head and ink cartridge are placed, the casing body having an opening smaller than the cavity formed along a part of path on which the carriage is moved in order to exchange the ink cartridge therethrough, and a cover member being closed to cover the opening and being opened to expose the opening;

instruction input means operated by an operator for inputting an instruction to exchange the ink cartridge;

operation detection means for detecting an operation state of the instruction input means;

cover state detection means for detecting whether the cover member is opened; and carriage control means for controlling a position of the carriage so as to move toward the opening when the operation detection means detects that the instruction input means has sustained the operation state for at least a predetermined time period, and the cover state detection means detects that the cover member is opened.

12. The ink jet recording apparatus as set forth in claim 8, further comprising:

alarm means to be driven when the operation detection means detects that the instruction input means has been manipulated for the predetermined time or longer.

13. The ink jet recording apparatus as set forth in claim 12, wherein audio alarm means is employed as the alarm means.

14. The ink jet recording apparatus as set forth in claim 12, wherein visual alarm means is employed as the alarm means.

15. The ink jet recording apparatus as set forth in claim 12, wherein means for generating an alarm by driving a mechanical part of the apparatus is employed as the alarm means.

16. The ink jet recording apparatus as set forth in claim 8, the recording head and the ink cartridge in the recording unit are separately provided.

17. The ink jet recording apparatus as set forth in claim 8, the recording head and the ink cartridge in the recording unit are integrally provided.

18. The ink jet recording apparatus as set forth in claim 9, further comprising:

alarm means to be driven when the operation detection means detects that the instruction input means has been manipulated for the predetermined time or longer.

19. The ink jet recording apparatus as set forth in claim 18, wherein audio alarm means is employed as the alarm means.

20. The ink jet recording apparatus as set forth in claim 18, wherein visual alarm means is employed as the alarm means.

21. The ink jet recording apparatus as set forth in claim 18, wherein means for generating an alarm by driving a mechanical part of the apparatus is employed as the alarm means.

22. The ink jet recording apparatus as set forth in claim 9, the recording head and the ink cartridge in the recording unit are separately provided.

23. The ink jet recording apparatus as set forth in claim 9, the recording head and the ink cartridge in the recording unit are integrally provided.

24. The ink jet recording apparatus as set forth in claim 11, further comprising:

alarm means to be driven when the operation detection means detects that the instruction input means has been manipulated for the predetermined time or longer.

25. The ink jet recording apparatus as set forth in claim 24, wherein audio alarm means is employed as the alarm means.

26. The ink jet recording apparatus as set forth in claim 24, wherein visual alarm means is employed as the alarm means.

27. The ink jet recording apparatus as set forth in claim 24, wherein means for generating an alarm by driving a mechanical part of the apparatus is employed as the alarm means.

28. The ink jet recording apparatus as set forth in claim 11, the recording head and the ink cartridge in the recording unit are separately provided.

29. The ink jet recording apparatus as set forth in claim 11, the recording head and the ink cartridge in the recording unit are integrally provided.

30. The ink jet apparatus as set forth in claim 9, wherein the operator controls whether the operation state is sustained for the predetermined time period.

31. The ink jet recording apparatus as set forth in claim 30, wherein the predetermined time period is in a range of 3 to 5 seconds.

32. The ink jet recording apparatus as set forth in claim 11, wherein the operator controls whether the operation state is sustained for the predetermined time period.

33. The ink jet recording apparatus as set forth in claim 32, wherein the predetermined time period is in a range of 3 to 5 seconds.

34. An ink jet recording apparatus, comprising:

an ink jet recording unit including a recording head having nozzle orifices from which ink drops are ejected, an ink cartridge for supplying ink to the recording head, a carriage on which the recording head and the ink cartridge are mounted and being moved in a width direction of a recording sheet;

a casing body for accommodating the ink jet recording unit and for covering a cavity in which the recording head and ink cartridge are placed, the casing body having an opening smaller than the cavity formed along a part of path on which the carriage is moved in order to exchange the ink cartridge therethrough, and a cover member being closed to cover the opening and being opened to expose the opening an ink end detector detecting the ink end of the ink cartridge;

a cover state detector detecting whether the cover member is opened; and a carriage controller controlling a position of the carriage so as to move toward the opening when the ink end detector detects that ink has been exhausted and when the cover state detector detects that the cover member is opened.

35. The ink jet recording apparatus as set forth in claim 34, further comprising:

a capping mechanism sealing a surface of the recording head on which the nozzle orifices are formed and drawing ink out through the nozzle orifices by the application of negative pressure generated by a negative pressure generator, wherein the opening is situated other than a home position whereat the capping mechanism is provided.

36. The ink jet recording apparatus as set forth in claim 34, wherein the ink end detector includes a cartridge detector detecting whether the ink cartridge is mounted on the carriage, and a counter counting the amount of ink ejected by the recording head which is reset when the cartridge detector detects that a new ink cartridge is mounted, wherein the ink detector determines that the ink has been exhausted when a value held by the counter reaches a predetermined count.

37. The ink jet recording apparatus as set forth in claim 34, wherein the ink end detector detects conductivity in the ink cartridges through electrodes embedded therein, and makes a determination that the ink has been exhausted based on the detected conductivity.

38. The ink jet recording apparatus as set forth in claim 35, wherein the carriage controller moves the carriage toward the home position when the cover state detector detects that the cover member is closed.

39. The ink jet recording apparatus as set forth in claim 35, further comprising:

a cleaning controller driving the negative pressure generator to apply the negative pressure into the capping mechanism which seals the surface of the recording head on which the nozzle orifice are formed, the cleaning controller being activated when the cover state detector detects that the cover member is closed and the cartridge detector detects that a new ink cartridge has been mounted on the carriage.

40. The ink jet recording apparatus as set forth in claim 39, wherein the cartridge detector has a flag indicating whether the ink cartridge is mounted on the carriage, which is turned into ON state when the ink cartridge is removed from the carriage, and is returned into OFF state after the cleaning operation for the new ink cartridge is terminated.

41. The ink jet recording apparatus as set forth in claim 34, further comprising:

an instruction input device operated by an operator to input an instruction to exchange the ink cartridge; and an operation detector detecting an operation state of the instruction input device, wherein the carriage controller moves the carriage toward the opening when the operation detector detects that the instruction input device is operated for a predetermined time period or longer.

42. The ink jet apparatus as set forth in claim 41, wherein the operator controls whether the operation state is sustained for the predetermined time period.

43. The ink jet recording apparatus as set forth in claim 42, wherein the predetermined time period is in a range of 3 to 5 seconds.

* * * * *